United States Patent [19]

Hoop

[11] 4,163,576

[45] Aug. 7, 1979

[54] MEANS FOR SUSPENDING ARTICLES FROM A CEILING

[76] Inventor: James B. Hoop, 8127 E. 12th-Apt. 2, Tulsa, Okla. 74112

[21] Appl. No.: 899,386

[22] Filed: Apr. 24, 1978

[51] Int. Cl.[2] ..... A47F 13/06

[52] U.S. Cl. ..... 294/19 R

[58] Field of Search ..... 294/19 R, 85; 248/339, 248/340, 343, 317, 228, 72; 29/225

[56] References Cited

U.S. PATENT DOCUMENTS

| | | | |
|---|---|---|---|
| 3,327,376 | 6/1967 | Freeman et al. | 294/19 R |
| 3,561,718 | 2/1971 | Iverson | 294/19 R |
| 4,074,885 | 2/1978 | Hacker, Jr. | 248/317 |

*Primary Examiner*—James B. Marbert

*Attorney, Agent, or Firm*—Head, Johnson & Chafin

[57] ABSTRACT

A device for suspending articles from a ceiling and comprising a sleeve member having an external hook secured at one end thereof for receiving the article thereon, a pair of pivotal gripping members secured to the sleeve at a common pivot point and pivotal in directions toward and away from each other to provide alternate gripping and releasing positions for the device, a threaded stem securing the pivotal gripping members to the sleeve member whereby rotation of the sleeve member in one direction engages the pivotal gripping members for movement thereof toward the gripping position and rotation in an opposite direction permits pivotal movement of the gripping members in a direction toward the releasing position, and a tool engageable with the hook member for transmitting rotation to the sleeve and for alternately positioning the article on the hook and removing the article therefrom.

8 Claims, 13 Drawing Figures

MEANS FOR SUSPENDING ARTICLES FROM A CEILING

BACKGROUND OF THE INVENTION

1. Field of the Invention

This invention relates to improvements in hanging devices and more particularly, but not by way of limitation, to a device for facilitating the suspending of articles from a ceiling.

2. Description of the Prior Art

In many places, such as department stores, grocery stores and the like, it is frequently desirable to suspend articles, such as displays and the like, from relatively high ceilings. At the present time, it is usually necessary for the person installing the suspended articles to climb relatively high ladders and work in somewhat precarious positions for attaching the holding devices to the ceiling. The hazards of this work are considered disadvantageous by OSHA, and in addition are time consuming for the person doing the installing operation.

SUMMARY OF THE PRESENT INVENTION

The present invention contemplates a novel device which may be secured or clamped to a ceiling from a standing position on the floor beneath the site of the installation without the necessity of climbing a ladder, or the like, and in addition, a companion device is provided which not only facilitates the installation of the device on the ceiling but also facilitates the attaching of the articles being suspended to the hanging device. The device comprises a pair of gripping or catch members each having one end pivotally secured to the end of the other and having a suitable spring interposed therebetween for constantly urging the catch members in a direction away from each other. The catch members are mounted on a threaded shank in such a manner that rotation of the shank in one direction results in a longitudinal movement of the shank in one direction with respect to the catch members and rotation of the shank in an opposite direction causes the shank to move in an opposite direction with respect to the catch members. The shank member is carried by a sleeve member having one open end through which the shank member and catch members extend, and having a suitable external hook member secured at the opposite end thereof. Rotation of the sleeve causes a simultaneous rotation of the shank member and, of course rotation of the sleeve in one direction causes the shank member to move in a direction for carrying the sleeve toward the catch members and rotation of the sleeve in an opposite direction causes the shank member to move in an opposite direction for carrying the sleeve away from the catch members.

When the sleeve is moved toward the catch members, the open end thereof engages the opposite sides of the catch members and pivots them toward each other against the force of the spring. When the sleeve is moved away from the catch members, the spring returns the catch members to the normal extended position therefor. In the extended position of the catch members, the outer ends thereof are spaced apart a sufficient distance for being disengaged from the installed position on the ceiling, and in the contracted position of the catch members, the device may be securely clamped in position on the ceiling.

In addition, an auxiliary tool is provided for facilitating the rotation of the sleeve member from a position remote therefrom, and for facilitating disposing of the article on the hook member and removing the article from the hook member. The complementary devices are simple and efficient in operation and economical and durable in construction.

DETAILED DESCRIPTION OF THE PREFERRED EMBODIMENTS

Figure 1:
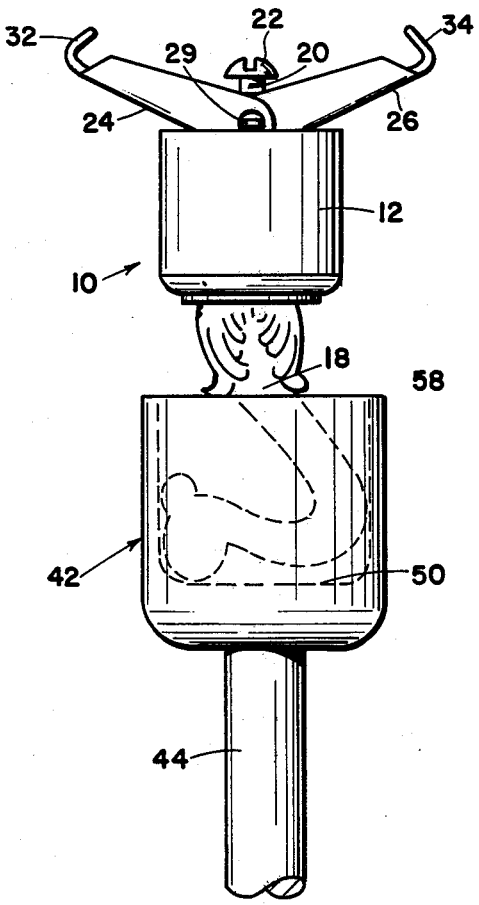
FIG. 1 is a side elevational view of a suspending device embodying the invention and illustrated in a position for disengagement from an installed condition.

Referring to the drawings in detail, reference character 10 generally indicates a device for suspending articles from a ceiling and which comprises a substantially cylindrical sleeve 12 having one end thereof closed by a wall 14 and the opposite end thereof open as shown at 16. A hook member 18 of any well-known type is secured to the outer surface of the wall 14 in any suitable manner whereby rotation of the hook 18 about a vertical axis as viewed in the drawings will transmit rotation to the sleeve 12 about its own longitudinal axis. A threaded shank member 20 is secured to the wall 14 in any suitable manner for rotation simultaneously with the sleeve 12 and is preferably centrally disposed therein as particularly shown in FIGS. 4 and 6. The shank member 20 extends longitudinally through the interior of the sleeve 12 and protrudes outwardly from the open end 16 thereof. A stop member or head 22 is provided on the outer end of the shank 20 for a purpose as will be hereinafter set forth.

A pair of substantially identical, oppositely disposed catch members 24 and 26 of substantially U-shaped cross-sectional configuration cooperate to provide a clamp for the device 10. The catches 24 and 26 each have the corresponding or abutting ends thereof pivotally secured to a pivot member 27, and a suitable helical spring 30 carried by pivot member 27 has one end in engagement with the catch 24 and the opposite end in engagement with the catch 26 for constantly urging the catches in directions away from each other to provide a normal extended position therefor. The outer ends of the catches 24 and 26 are provided with an inwardly directed flange member 32 and 34, respectively, for a purpose as will be hereinafter set forth.

The pivot member 27 may be of any suitable type, but as shown herein comprises an internally threaded nut member 28 having a pair of substantially identical studs 29 extending outwardly from the opposite sides thereof for pivotally receiving the catch members 24 and 26 thereon. The nut member 28 is threadedly disposed on the shank 20, but is held against rotation simultaneously therewith by the catch members 24 and 26, particularly when the catch member 24 and 26 are in an engaged position as will be hereinafter set forth. Thus, when the shank 20 is rotated, the shank 20 will move longitudinally with respect to the nut 28, and will move in an axial path between the catches.

Figure 3:
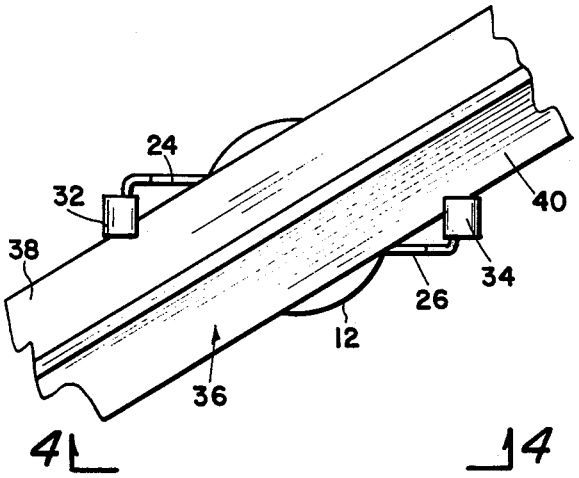
FIG. 3 is a top view of a support element of a ceiling and showing a suspending device embodying the invention in a released position during an installation operation.
Figure 5:
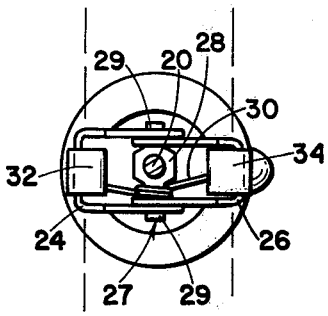
FIG. 5 is a top view of a suspending device embodying the invention in a gripping position, with a support element of a ceiling shown in broken lines for purposes of illustration.
Figure 4:
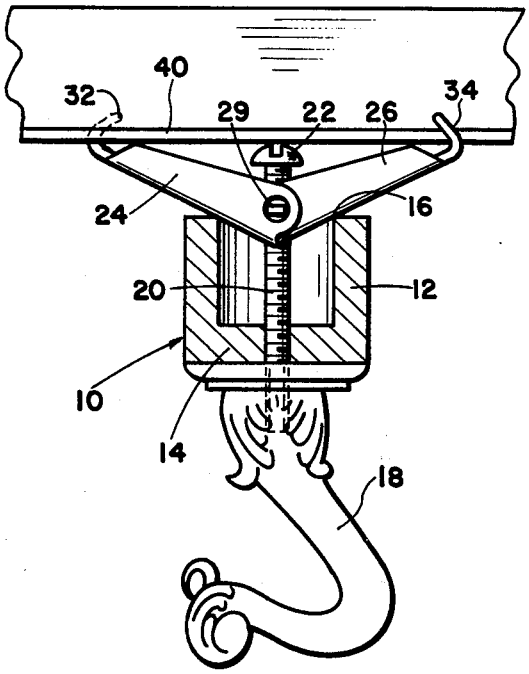
FIG. 4 is a view taken on line 4—4 of FIG. 3.

In order to install the device 10 on a ceiling whereby the hook 18 may be utilized for suspending articles therefrom, the device 10 having the catch members 24 and 26 in the normal extended position thereof as shown in FIGS. 1, 3, and 4, may be moved to a position in the proximity of the usual ceiling support member 36 such as in widespread use today in the construction of ceilings commonly known as suspended ceilings. Of course, the catch members 24 and 26 may be positioned in a similar relationship with substantially any suitable support members wherein the device 10 is to be installed and is not limited to use with the particular ceiling support 36 shown herein. The support 36 is normally of a substantially T-shaped cross-sectional configuration providing a pair of oppositely disposed flanges 38 and 40 extending longitudinally along the opposite sides thereof. The flanges 32 and 34 may be brought into a position adjacent the flanges 38 and 40, respectively, as shown in FIGS. 3 and 4, and the sleeve member 12 may be rotated in one direction in any suitable manner for rotating the shank 20 in a direction for moving through the nut 28 in an upwardly direction as viewed in the drawings.

Figure 6:
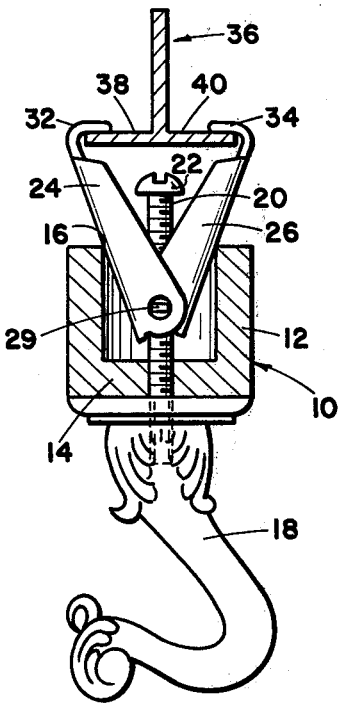
FIG. 6 is a sectional elevational view, partly in elevation, of a suspending device embodying the invention as installed on a support element of a ceiling.

Since the sleeve 12 moves simultaneously with the shank 20, the sleeve 12 is also moved upwardly with respect to the nut 28 and catch members 24 and 26. The open end 16 of the sleeve 12 is normally in engagement with the outer periphery of the catch member 24 and 26 in a relatively relaxed position therebetween and upon the upward movement of the sleeve 12 the open end 16 is brought into a more forceful engagement with the catch member 24 and 26 and pivots the catches against the force of the spring 30 to the position therebetween as shown in FIG. 6. The flanges 32 and 34 are thus moved into a gripping or catching engagement with the opposed flanges 38 and 40 for securely clamping the device 10 to the support member 36. The hook 18 is then securely anchored to the ceiling, and the articles to be suspended from the ceiling may be hung from the hook 18 as will be hereinafter set forth.

In order to facilitate the manipulation of the sleeve 12 during installation of the device 10 on the support member 36, a complementary tool 42 is provided with the device 10. The tool 42 comprises an elongated rod or staff 44 having a cup 46 provided at one end thereof and a yoke member 48 provided at the opposite end thereof. The rod 44 is preferably of a sufficient length whereby the person installing the device 10 on the support member 36 may comfortably stand on the floor (not shown) beneath the ceiling and reach the ceiling with both the cup 46 and yoke 48 for the purposes as will be hereinafter set forth.

Figure 7:
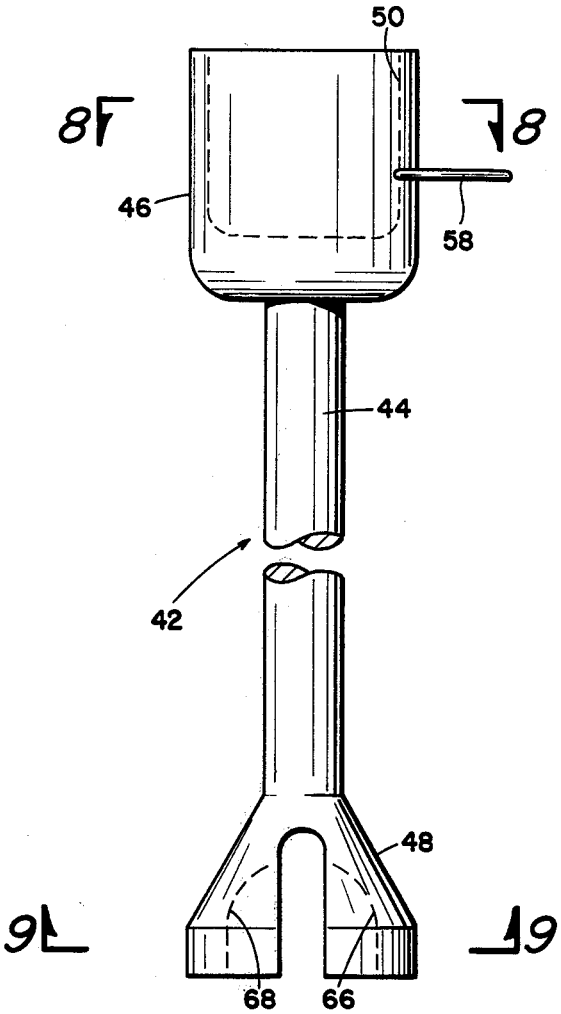
FIG. 7 is a broken elevational view of an installation tool of a suspending device embodying the invention.
Figure 8:
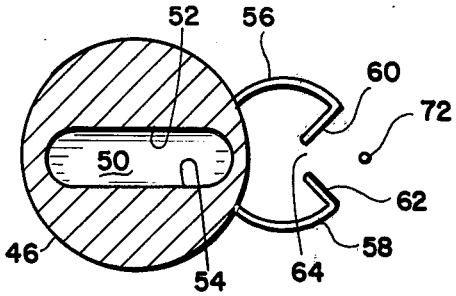
FIG. 8 is a view taken on line 8—8 of FIG. 7.
Figure 10:
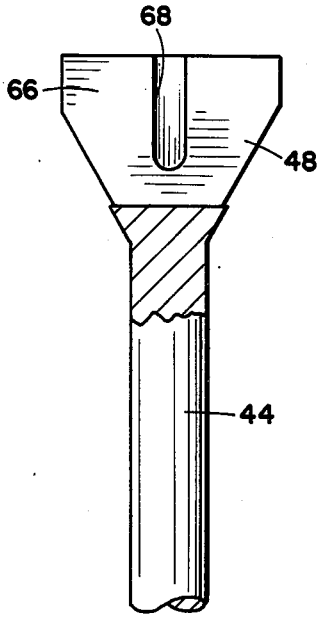
FIG. 10 is a view taken on line 10—10 of FIG. 9, with portion thereof shown in elevation for purposes of illustration.
Figure 9:
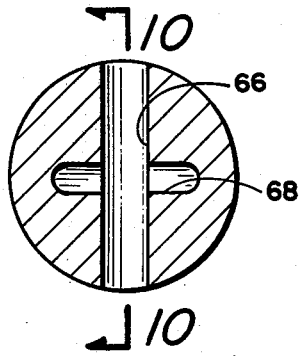
FIG. 9 is a view taken on line 9—9 of FIG. 7.

The cup member 46 is provided with an internal recess 50 extending longitudinally therein and open at the outer end thereof. The recess 50 is provided with oppositely disposed sidewalls 52 and 54 spaced apart a distance slightly greater than the width of the thickness of the hook 18 and of a depth complementary to the hook whereby the hook may be readily received within the recess as shown in FIG. 1. In addition, a pair of substantially identical oppositely disposed yieldable finger members 56 and 58 are secured to the outer periphery of the cup 46 and extend substantially radially outwardly therefrom as particularly shown in FIGS. 7 and 8. The fingers 56 and 58 are preferably constructed from a suitable spring material, and the outer end of each finger is provided with an angularly inwardly directed guide member 60 and 62, respectively, with a slight gap or hiatus 64 provided therebetween.

The yoke member 48 is preferably of a substantially conical configuration and is provided with a diametrically extending recess 66 of an overall configuration generally similar to the recess 50 but having the opposite ends thereof open. A second recess 68 is provided in the yoke member 48 and is disposed substantially perpendicular with respect to the recess 66. In addition, the recess 68 is preferably of a depth somewhat less than the depth of the recess 66, and is open only at the outer end thereof.

In order to facilitate the installation of the device 10 in engagement with the support member 36, the tool 42 may be manually grasped in any well-known manner and in such a manner that the hook 18 may be removably disposed within the recess 50, as shown in FIG. 1. The tool 42 may then be manipulated for moving the device 10 into the proximity of the support member 36 as shown in FIGS. 3 and 4, with the flanges 32 and 34 positioned in the proximity of the flanges 38 and 40, and the rod 44 may be manually rotated about its own longitudinal axis in the proper direction for moving the sleeve 12 in a direction toward the support member 36. In this manner, the catches 24 and 26 are moved in a direction toward one another and the flanges 24 and 26 are securely clamped on the flanges 38 and 40 for securing the device 10 to the support member 36. The cup 46 may then be removed from engagement with the device 10 by withdrawing the recess 50 from the hook 18.

Figure 2:
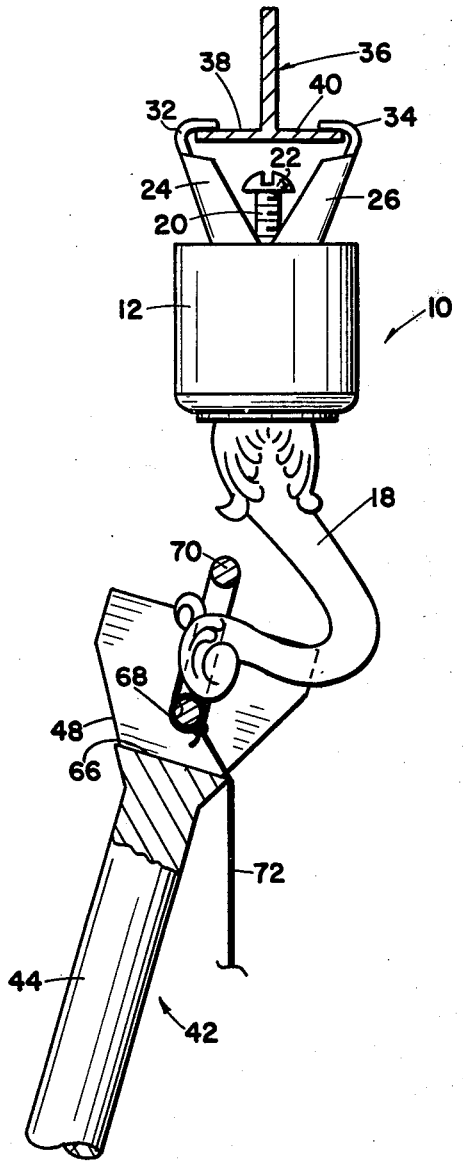
FIG. 2 is an elevational view, partly in section, of a suspending device embodying the invention and illustrated in an installed position on a ceiling.

With the device 10 properly clamped on the support member 36, the tool 42 may be reversed in position whereby the yoke member 48 may be moved to the proximity of the hook member 18. A suitable hanging or suspending element 70, such as a link of a chain having a rope or string 72 secured thereto, said string 72 being fastened to the article (not shown) to be suspended from the ceiling, may be removably or loosely disposed in the recess 68 as shown in FIG. 2. With the suspending element 70 disposed in the recess 68, the tool 42 may be properly manipulated for positioning the yoke 48 in the proximity of the hook 18 in order that the recess 66 may be moved over the hook in such a manner that the suspending element 70 may be disposed or deposited on the hook 18 in the normal manner. When this has been accomplished, the yoke 48 may be removed from engagement with the hook 18 and suspending element 70 by lowering the yoke 48 or moving the yoke 48 in a direction away from the device 10. In this manner the hanging or suspending element 70 will be supported by the hook 18 and the article carried by the element 70 will thus be suspended from the ceiling for display, or the like.

In order to remove the displayed article from its suspended position, the yoke 48 may be utilized for retrieving the suspending element 70 from the hook 18 in a substantially reverse manner from that employed in the positioning of the element 70 thereof. In order to facilitate the retrieval of the element 70, it may be desirable to utilize the yieldable fingers 56 and 58 for engaging the rope or wire 72. In this event, the yoke 48 may be moved in a lateral direction with regard to the wire 72 in order that the hiatus 64 may be moved transversely over the wire 72 and trapping the wire within the area defined by the fingers 56 and 58. In this manner, the element 70 may more readily be positioned within the recess 68 when the element 70 is disposed in the relatively high position of the hook 18.

Figure 13:
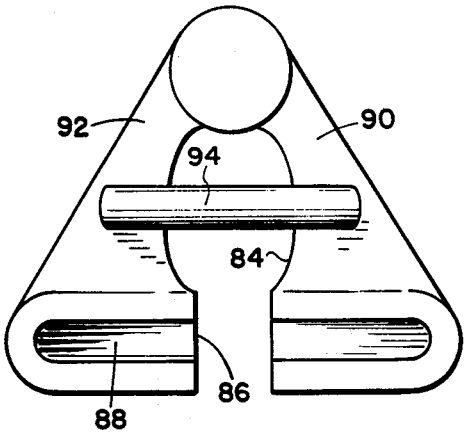
FIG. 13 is a view taken on line 13—13 of FIG. 12.
Figure 12:
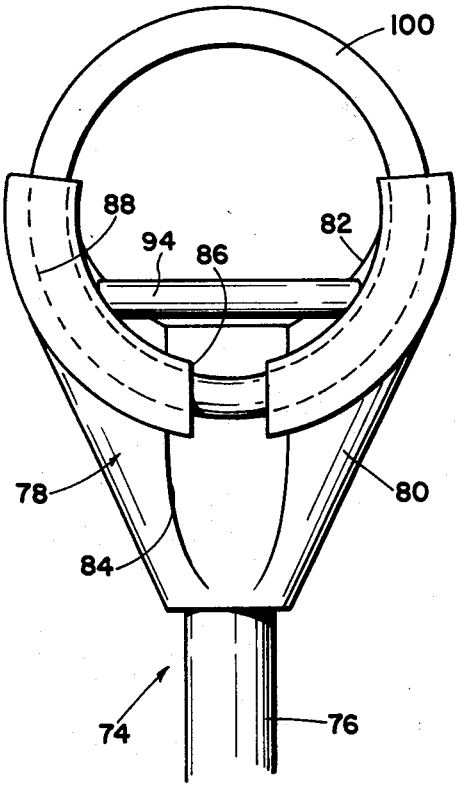
FIG. 12 is a front elevational view of the modified tool shown in FIG. 11.
Figure 11:
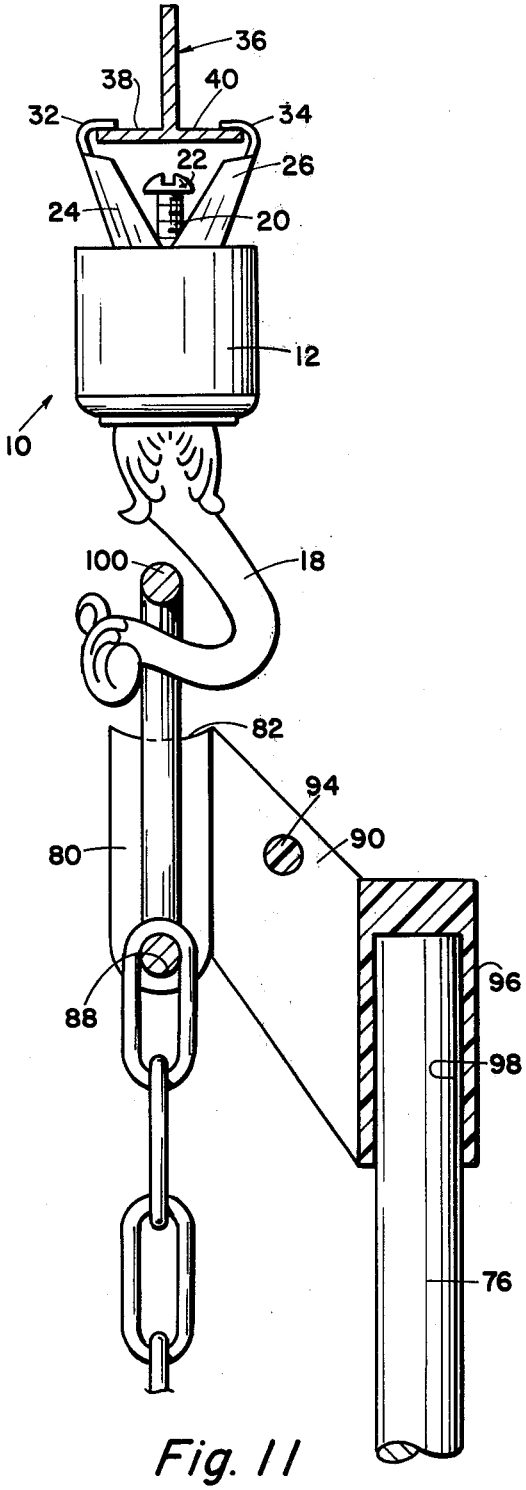
FIG. 11 is an elevational view partly in section of a device embodying the invention secured to a ceiling and illustrating a modified tool of the invention.

Referring now to FIGS. 11 through 13, a modified tool generally indicated at 74 is shown which is somewhat similar to the tool 42 and comprises an elongated staff 76 similar to the shaft 44 having the cup member 46 provided at one end thereof and a modified yoke member 78 provided at the opposite end thereof. The yoke 78 comprises a substantially V-shaped body 80 with the outer end 82 thereof having a substantially semi-circular configuration. A centrally disposed recess 84 is provided in the body 80 forming a hiatus 86 in the circular end 82. A circular recess 88 is provided in the end 82 open to the inner edge thereof and is interrupted at the hiatus 86. The body 80 is suitably secured to a pair of diverging bracket members 90 and 92 having a strengthening rod 94 secured therebetween. The brackets 90 and 92 are secured to the outer periphery of a sleeve or cap member 96 having a central bore 98 extending therein for receiving the rod 76 therein in order to secure the yoke 74 to the rod at the opposite end thereof with respect to the cup 46.

The yoke 74 may be utilized for installing the device 10 on the support member 36 in substantially the same manner as hereinbefore set forth. In this particular embodiment it is anticipated that the suspending element 70 may be provided with a relatively large ring member 100 on the outer end thereof, and the ring member 100 may be inserted within the recess 88 as particularly shown in FIG. 12, whereupon the tool 74 may be manipulated for elevating the ring 100 into position on the hook 18 as shown in FIG. 11. In this manner the article (not shown) to be suspended from the ceiling for display may be easily connected with the device 10. A reverse procedure may be utilized for removing the ring 100 from engagement with the hook 18 when it is desired to remove the display article from its suspended position with respect to the ceiling.

From the foregoing it will be apparent that the present invention provides a novel device for facilitating the suspending of articles from a ceiling. The device comprises clamping means which may be readily actuated from a remote position for installation on or removal from a ceiling support member. A tool member is provided for quickly and easily engaging the article to the clamping means for suspending the article from the ceiling, and quickly and easily removing the article from its suspended position when desired.

Whereas the present invention has been described in particular relation to the drawings attached hereto, it should be understood that other and further modifications, apart from those shown or suggested herein may be made within the spirit and scope of this invention.

What is claimed is:

1. A device for facilitating securing of articles to a ceiling and comprising gripping means having alternate extended and contracted positions for selective engagement with the ceiling, sleeve means secured to said gripping means and reciprocal with respect thereto and having one end engageable with the gripping means for providing said extended and contracted positions therefor, hook means carried by said sleeve for receiving said article thereon, and tool means cooperating with the hook means for providing reciprocal movement for the sleeve means from a position remote with respect to the ceiling, and including threaded means for securing the sleeve means to the gripping means to provide said reciprocal movement therefor.

2. A device as set forth in claim 1 wherein the threaded means is threadedly secured to the gripping means and responsive to rotation about a longitudinal axis for reciprocal movement with respect to the gripping means for providing said movement for the sleeve means.

3. A device as set forth in claim 2 wherein the hook means is rigidly secured to the sleeve means for simultaneous movement therebetween, and said tool means is selectively engagable with the hook means for rotation of the hook about a longitudinal axis for transmitting said rotational movement to the threaded means for selective extension and contraction of the gripping means.

4. A device as set forth in claim 3 wherein the tool means comprises an elongated rod having hook engaging cup means provided at one end thereof for transmitting said rotational movement thereto.

5. A device as set forth in claim 4 wherein the cup means comprises a substantially cylindrical body member having an internal recess therein of a configuration complementary to the configuration of the hook means for receiving the hook means therein and encasing the hook means in a manner whereby rotation of the rod about its longitudinal axis transmits rotation to the hook means.

6. A device as set forth in claim 4 wherein the tool means includes yoke means at the opposite end of the rod for receiving the article thereon and transporting the article to the hook means when the device is secured to a ceiling.

7. A device as set forth in claim 6 wherein the yoke means comprises a body member having a first recess provided therein for receiving the article therein, and a second recess provided therein substantially perpendicular to the first recess for receiving the hook means therein during transferring of the article from the yoke means to the hook means.

8. A device as set forth in claim 7 wherein at least one of said recesses is provided with open ends for facilitating manipulation of the tool during positioning of the article on the hook means and removing the article therefrom.

* * * * *